US009439014B2

(12) United States Patent
Yeh et al.

(10) Patent No.: US 9,439,014 B2
(45) Date of Patent: Sep. 6, 2016

(54) MICROPHONE DETECTION AND SELECTION CIRCUIT AND METHOD

(71) Applicant: REALTEK SEMICONDUCTOR CORPORATION, Hsinchu (TW)

(72) Inventors: Ming-Yuh Yeh, Taipei (TW); Chen-Chun Fan, Taoyuan County (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 301 days.

(21) Appl. No.: 13/930,047

(22) Filed: Jun. 28, 2013

(65) Prior Publication Data

US 2014/0286494 A1 Sep. 25, 2014

(30) Foreign Application Priority Data

Mar. 22, 2013 (TW) ..... 102110392 A

(51) Int. Cl.
*H04R 29/00* (2006.01)
*H04R 1/10* (2006.01)

(52) U.S. Cl.
CPC ..... *H04R 29/004* (2013.01); *H04R 2499/15* (2013.01)

(58) Field of Classification Search
CPC ..... H04R 29/004; H04R 2499/15
USPC ..... 381/56, 74, 122, 123, 92, 113, 58, 111, 381/174, 323, 94.5; 455/115.1, 115.3, 574; 704/E15.04, 246, 275
See application file for complete search history.

(56) References Cited

U.S. PATENT DOCUMENTS

2012/0200172 A1* 8/2012 Johnson ..... H04R 29/001 307/116
2013/0320993 A1* 12/2013 Mehrabi ..... G01R 31/04 324/508

* cited by examiner

*Primary Examiner* — Vivian Chin
*Assistant Examiner* — Ammar Hamid
(74) *Attorney, Agent, or Firm* — WPAT, P.C., Intellectual Property Attorneys; Anthony King

(57) ABSTRACT

The present invention discloses a microphone detection circuit for detecting whether an external device includes a microphone. The microphone detection circuit comprises: an audio circuit for receiving an analog input signal which is a signal from the external device or a preset signal. The audio circuit comprises: an analog-to-digital conversion unit to generate a digital audio signal according to the analog input signal; a decision unit, coupled to the analog-to-digital conversion unit, to determine whether the digital audio signal satisfies a predetermined threshold to thereby generate an analysis result, wherein if the digital audio signal satisfies the predetermined threshold, the analysis result indicates that the external device includes a microphone; and a control unit, coupled to the decision unit, to control an operation of the audio circuit according to the analysis result.

19 Claims, 5 Drawing Sheets

MICROPHONE DETECTION AND SELECTION CIRCUIT AND METHOD

BACKGROUND OF THE INVENTION

1. Field of the Invention

The present invention relates to an audio circuit, especially to microphone detection and selection circuits and the related methods.

2. Description of Related Art

In order to satisfy the demand of identifying or recording acoustic signals, an electronic device usually has a built-in microphone and concurrently supports an external microphone which may electrically connect to the electronic device through a physical connection. If the electronic device detects no external microphones, it will carry out an audio process according to the acoustic signals from the built-in microphone; however, if the electronic device detects an external microphone, it will carry out the audio process with the external microphone instead. Generally, the electronic device will determine whether the external microphone exists by the jack detection with a microphone dedicated socket. But in some circumstances, the external microphone is integrated into an external device; under such conditions, the electronic device provided with proper design can also detect whether the external microphone of the external device exists through the jack detection with a composite socket. For instance, distinct positions of the composite socket of the electronic device are dedicated to connecting with distinct parts of the plug of the external device while the distinct parts are isolated from each other, and thus the electronic device can detect the signals corresponding to the distinct parts to catch the functions of the external device and find out whether the external device includes an external microphone. Unfortunately, the current art such as the disclosure of U.S. Pat. No. 7,912,501 uses an independent analog circuit to detect the existence of the external microphone through the composite socket; since the independent analog circuit consumes circuit area, leads to higher cost and is not integrated into the digital domain, it leaves room for improvement.

Besides, in the current art, once the electronic device detects the external microphone, it will use the external microphone instead to proceed with the audio process. However, if the electronic device is performing recording by the built-in microphone in the meantime, using the external microphone instead will most likely cause the discontinuous recording effect or lose a part of the recording content.

In consideration the deficits of the current microphone detection and selection technique, this industrial filed needs a device and a method to do microphone detection and/or choose an external microphone or a built-in microphone by the state of an electronic device.

SUMMARY OF THE INVENTION

Regarding the deficits of the prior art, a purpose of the present invention is to provide microphone detection and selection circuits and the related methods for the improvement to the prior art.

The present invention discloses a microphone detection circuit for detecting whether an external device includes a microphone. According to an embodiment of this invention, the microphone detection circuit comprises: an audio circuit for receiving an analog input signal which is a signal from the external device or a preset signal. Said audio circuit includes: at least one analog-to-digital conversion unit to generate a digital audio signal according to the analog input signal; a decision unit, coupled to the analog-to-digital conversion unit, to determine whether the digital audio signal satisfies a predetermined threshold to thereby generate an analysis result, wherein if the digital audio signal satisfies the predetermined threshold, the analysis result indicates that the external device includes a microphone; and a control unit, coupled to the decision unit, to control an operation of the audio circuit according to the analysis result.

The present invention also discloses a microphone detection method for detecting whether an external device includes a microphone. This method could be carried out by the disclosed microphone detection circuit or the equivalent device thereof. According to an embodiment of the present invention, the microphone detection method comprises the following steps: generating a digital audio signal according to an analog input signal which is a signal from the external device or a preset signal; determining whether the digital audio signal satisfies a predetermined threshold to thereby generate an analysis result in which the analysis result indicates that the external device includes the microphone if the digital audio signal satisfies the predetermined threshold; and executing an operation according to the analysis result.

The present invention further discloses a microphone selection circuit for selecting one microphone among a plurality of microphones. According to an embodiment of this invention, the microphone selection circuit comprises: an audio circuit for receiving a first analog input signal of an external microphone and/or a second analog input signal of a built-in microphone. Said audio circuit includes: at least one analog-to-digital conversion unit to generate a digital audio signal according to the first or second analog input signal; a decision unit to generate an analysis result according to one or more parameters associated with at least one state of a microphone signal process; and a control unit, coupled to the decision unit and the analog-to-digital conversion unit, to make the analog-to-digital conversion unit generate the digital audio signal by the first or second analog input signal in accordance with the analysis result, and make the audio circuit execute the microphone signal process with the digital audio signal.

Moreover, the present invention discloses a microphone selection method for selecting one microphone among a plurality of microphones. This method could be carried out by the mentioned microphone selection circuit or the equivalent circuit thereof. According to an embodiment of the present invention, the microphone selection method comprises the following steps: receiving a first analog input signal from an external microphone and/or a second analog input signal from a built-in microphone; generating an analysis result according to one or more parameters associated with at least one state of a microphone signal process; and converting the first or second analog input signal into a digital audio signal according to the analysis result and then executing the microphone signal process with the digital audio signal.

These and other objectives of the present invention will no doubt become obvious to those of ordinary skill in the art after reading the following detailed description of the preferred embodiments that are illustrated in the various figures and drawings.

DETAILED DESCRIPTION OF THE PREFERRED EMBODIMENTS

Figure 1:
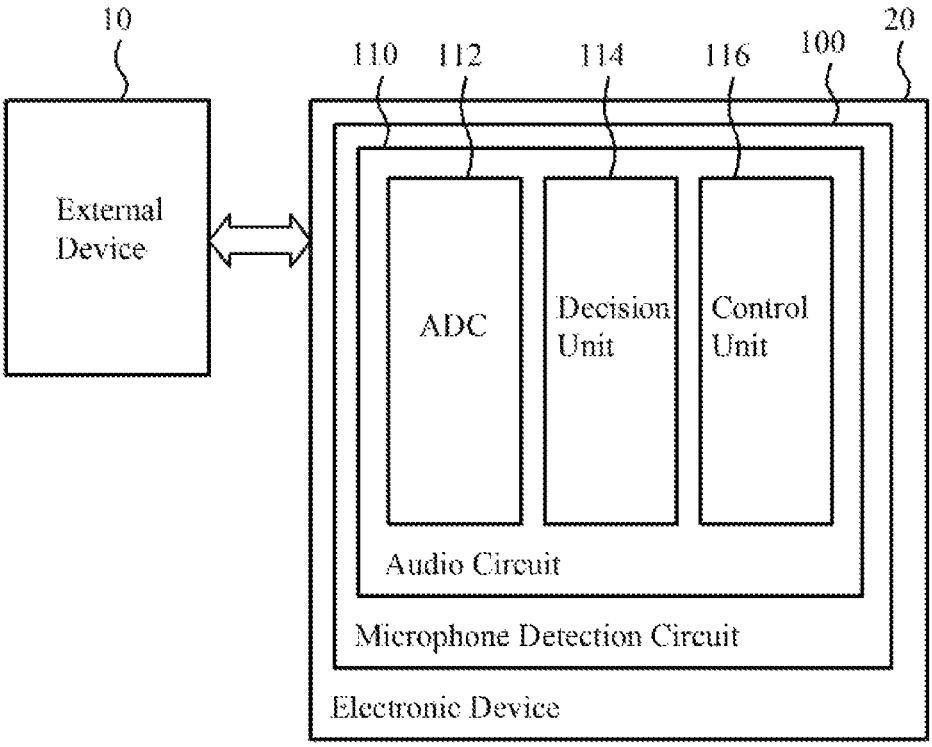
FIG. 1 illustrates an embodiment of the microphone detection circuit of the present invention.

The following description uses language by referring to terms of the filed of this invention. If any term is defined in the specification, such term should be explained accordingly. Besides, the connection between objects or events in the disclosed embodiments can be direct or indirect provided that these embodiments are still applicable under such connection. The mentioned "indirect" means that an intermediate object or a physical space is existed between the objects, or an intermediate event or a time interval is existed between the events. In addition, the following description relates to microphone detection and selection, and thus the known detail in this filed will be omitted if such detail has little to do with the features of the present invention. Furthermore, the shape, size, and ratio of any element and the step sequence of any flow chart in the disclosed figures are just exemplary for understanding, not for limiting the scope of this invention.

Besides, each embodiment in the following description includes one or more features; however, this doesn't mean that one carrying out the present invention should make use of all the features of one embodiment at the same time, or should only carry out different embodiments separately. In other words, if an implementation derived from one or more of the embodiments is applicable, a person of ordinary skill in the art can selectively make use of some or all of the features in one embodiment or selectively make use of the combination of some or all features in several embodiments to have the implementation come true, so as to increase the flexibility of carrying out the present invention.

The present invention discloses microphone detection and selection circuits and the related methods. These circuits and methods are applicable to a lot of voice/sound reception devices such as portable electronic devices (e.g. laptop computers, smart phones, tablet computers, recording devices, and etc.) and stationary electronic devices (e.g. desktop computers, digital acoustic equipments, smart televisions, and etc.); however, these applications are not limitations to the present invention, just for understanding. People of ordinary skill in the art can choose components or steps equivalent to those described in this specification to carry out the present invention, which means that the scope of this invention is not limited to the embodiments in the specification. Since some or all elements of the microphone detection and selection devices of the present invention could be known; therefore, the detail of such elements will be omitted provided that the omission nowhere dissatisfies the specification and enablement requirements. Besides, the microphone detection and selection methods can be carried out by the microphone devices of this invention or other equivalent devices; likewise the following description will abridge the hardware details or well-known parts of the method provided that the disclosure still satisfies the specification and enablement requirements.

Please refer to FIG. 1 which illustrates an embodiment of the microphone detection circuit of the present invention. This embodiment is for detecting whether an external device includes a microphone and accordingly enabling, remaining or switching a microphone signal process. Said external device could be a wired or wireless headset, handheld device, portable device, or desktop device. As shown in FIG. 1, the microphone detection circuit 100 of the present invention comprises: an audio circuit 110 for receiving an analog input signal. More specifically, a plug of an external device 10 is connected with the socket of an electronic device 20 having the audio circuit 110. If the external device 10 includes a microphone, the analog input signal will be the signal generated by the microphone; however, if the external device 10 includes no microphones, the analog input signal will be a preset signal (e.g. a ground signal, a floating signal or a signal of a predetermined voltage level). Said audio circuit 110 can be an audio coder/decoder (Codec), including: at least one analog-to-digital conversion unit 112 (ADC) such as a multi-bit ADC to generate a digital audio signal according to the aforementioned analog input signal. To be more specific, if the analog input signal is the signal from the microphone of the external device 10, the digital audio signal will reflect an input voice/sound (e.g. human voice or background sound) to thereby have a value varying by time; but if the analog input signal is the aforementioned preset signal, the digital audio signal will be zero, a preset value or a constant value. The audio circuit 110 further comprises: a decision unit 114, which could be implemented by a programmable logic device defined by a hardware description language (e.g. VHDL, Verilog or the like), a digital filter designed in response to the digital audio signal, or the assembly composed of an amplifier, a comparator, an accumulator and/or a logic unit for doing a decision, coupled to the analog-to-digital conversion unit 112 to determine whether the digital audio signal satisfies a predetermined threshold to thereby generate an analysis result, wherein if the digital audio signal satisfies the predetermined threshold, the analysis result indicates that the external device 10 includes a microphone. For example, the decision unit 114 may sum or average the digital audio signal to obtain an audio value, and then compares the audio value with the predetermined threshold to find out whether the digital audio signal is derived from a microphone signal or not to consequently provide the analysis result. Moreover, the audio circuit 110 comprises a control unit 116, coupled to the decision unit 114, to control an operation (e.g. a microphone signal process) of the audio circuit according to the analysis result. For instance, the control unit 116 can update the content of at least a memory unit or keep the content unchanged according to the analysis result, so as to allow the audio circuit 110 enabling, remaining or switching the microphone signal process through accessing the content of the memory unit, in which the memory unit can be integrated into the audio circuit 110 or disposed outside the audio circuit 110. For another instance, the control unit 116 can control at least one switch by the analysis result, so that the audio circuit 110 can enable, remain or switch the microphone signal process through the electrical connection of the at least one switch. In other words, if the analysis result indicates that the external device 10 includes a microphone, the control unit 116 can make the audio circuit 110 use the microphone of the external device 10 to achieve the effect of enabling the microphone signal process, use a built-in microphone or no microphones to achieve the effect of remaining the microphone signal process, or use the microphone of the external device 10 instead of the built-in microphone to thereby achieve the effect of switching the microphone signal process. On the other hand, if the analysis result indicates that the external device 10 has no microphones, the control unit 116 can make the audio circuit 110 keep using the built-in microphone to fulfill the purpose of remaining the microphone signal process, or use no microphones to remain the microphone signal process (i.e. no microphone signal under processing in the mean time) no matter the built-in microphone existing or not.

In addition to the above description, in order to accomplish enabling, remaining or switching the microphone signal process within a reasonable time, the control unit 116 can further connect to the analog-to-digital conversion unit 112 and make it perform an analog-to-digital conversion to the analog input signal within a predetermined time after the external device 10 electrically couples to the audio circuit 110, so as to obtain the digital audio signal for the following procedure. Said predetermined time could be milliseconds, seconds, or a longer time as long as the predetermined time is enough for the digital audio signal reflecting whether a microphone signal exists or not. Besides, as described before, the decision unit 114 can generate the analysis result by comparing the digital audio signal with the predetermined threshold. To be more specific, if the digital audio signal is equal to or larger than the predetermined threshold, the analysis result will indicate that the external device 10 includes the microphone, or else indicate that the external device 10 has no microphones. Please note that there are many means that can directly or indirectly represent the digital audio signal equivalent to or larger than the predetermined threshold; all the means can be adopted by this invention provided that the enablement of the present invention is assured.

Figure 2:
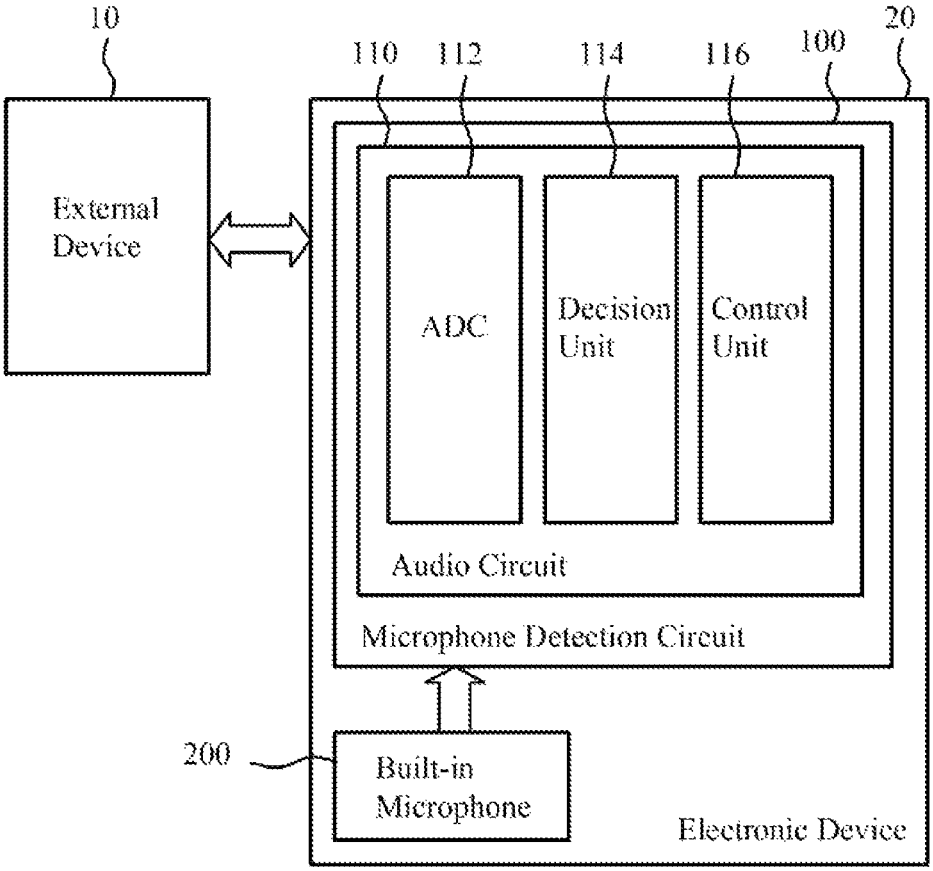
FIG. 2 illustrates another embodiment of the microphone detection circuit of the present invention.

Please refer to FIG. 2 which illustrates another embodiment of the microphone detection circuit of the present invention. The major difference between the embodiments of FIG. 2 and FIG. 1 is that the electronic device 20 of FIG. 2 not only comprises the microphone detection circuit 100 but also a built-in microphone 200, which means that the electronic device 20 supports the microphone of the external device 10 and possesses the built-in microphone at the same time. Since the electronic device 20 supports a plurality of microphones, the present embodiment further utilizes the audio circuit 100 to carry out a microphone selection function to select a microphone among the plurality of microphones and then execute the aforementioned microphone signal process. More specifically, in the present embodiment, if the digital audio signal from the analog-to-digital conversion unit 112 of the audio circuit 110 satisfies the aforementioned predetermined threshold, the decision unit 114 will generate the analysis result by additional one or more parameters, so as to allow the control unit 116 making the audio circuit 110 utilize the microphone of the external device 10, keep using the built-in microphone 200, or utilize the microphone of the external device 10 instead of the built-in microphone 200 for executing the microphone signal process, in which the one or more parameters are in connection with at least one state of the microphone signal process (e.g. a voice recognition state, a recording state and/or a microphone-signal-less state) and stored in one or several storage units or come from a program (such as an operating system). Said one or several storage units can be integrated into the audio circuit 110 or disposed outside it.

Based on the above description, in the present embodiment, the one or more parameters include a first parameter. If the first parameter corresponds to a first value, it means that the at least one state is associated with a first predetermined state (e.g. a voice recognition state); consequently, the decision unit 114 generates the analysis result according to the first parameter, and then the control unit 116 makes the audio circuit 110 execute a first microphone signal process by the microphone of the external device 10 and stop a second microphone signal process carried out by the built-in microphone 200 in accordance with the analysis result, so as to achieve the effect of switching the microphone signal process. Furthermore, if the first parameter corresponds to a second value (or a second parameter of the one or more parameters corresponds to the second value), it means that the state conforms to a second predetermined state (e.g. a recording state); under this case, the decision unit 114 will generate the analysis result in light of the first parameter (or the second parameter), and the control unit 116 will make the audio circuit 110 keep using the built-in microphone to execute the second microphone signal process according to the analysis result, so as to achieve the effect of remaining the microphone signal process. Moreover, if the first parameter corresponds to a third value (or a third parameter of the one or more parameters corresponds to the third value), it indicates that the state is associated with a third predetermined state (e.g. a microphone-signal-less state); under such condition, the decision unit 114 will generate the analysis result in light of the first parameter (or the third parameter), and the control unit 116 will make the audio circuit 110 use the microphone of the external device 10 according to the analysis result to perform the aforementioned first microphone signal process, so as to realize the effect of enabling the microphone signal process. Please note that if the state is associated with multiple states (e.g. a recording state and a voice recognition state), the control unit 116 can first determine which one of the multiple states corresponding to the highest priority by a preset priority order, and then choose to use the microphone of the external device 10 or the built-in microphone 200 according to the highest priority. Please also note that if the audio circuit 110 can deal with the microphone signal from the external device and the signal from the built-in microphone by two sets of circuits (e.g. two duplicate circuits), the present embodiment surely can take care of the microphone signal process with the external and built-in microphones at the same time. In another word, the control unit 116 not only makes the audio circuit 110 execute the first microphone signal process with the microphone of the external device 10, but also controls the audio circuit 110 to keep using the built-in microphone 200 for performing the second microphone signal process. Please further note that the aforementioned examples of the first, second and third predetermined states are for understanding, not limitations to the present invention, which means that a person of ordinary skill in the art can freely define those predetermined states based on preference or demands provided that the whole implementation is still executable.

Besides, considering that the contact-function definitions of the plug of the external device 10 and the socket of the electronic device 20 might be different from each other due to separate design, which means that the contact-function definitions pertaining to a first and a second contacts of the socket should be exchanged to conform to those of the plug, the control unit 116 can additionally execute an input signal swap operation (e.g. an operation to exchange the functions of the first and second contacts) when the digital audio signal dissatisfies the predetermined threshold, so as to make sure that the dissatisfaction is not due to the interchange of contact-function definitions. In detail, if the digital audio signal fails to satisfy the predetermined threshold, the control unit 116 will take the input signal swap operation; afterward, it will control the analog-to-digital conversion unit 112 to generate the digital audio signal by the analog input signal again, control the decision unit 114 to generate the analysis result by the regenerated digital audio signal, and then make the audio circuit 110 enable, remain or switch the microphone signal process by the regenerated analysis result. More descriptions about the input signal swap operation can be found in Applicant's prior U.S. patent application (application Ser. No. 13/873,870).

Figure 3:
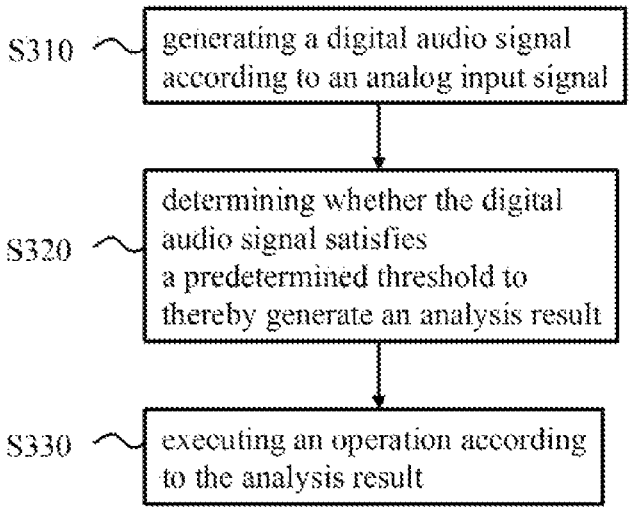
FIG. 3 illustrates an embodiment of the microphone detection method of the present invention.

In addition to the above-mentioned microphone detection circuit 100, the present invention discloses a microphone detection method for detecting whether an external device includes a microphone. The method can be executed by the microphone detection circuit 100 of the present invention or the equivalent circuit thereof. As shown in FIG. 3, an embodiment of the method comprises the following steps:

Step S310: generating a digital audio signal according to an analog input signal which can be the signal from said external device or a preset signal. In this embodiment, step S310 can further comprises: performing an analog-to-digital conversion to the analog input signal for a predetermined time, so as to generate the digital audio signal. Said preset signal and predetermined time can be well appreciated through the description of the embodiment in re FIG. 1;

Step S320: determining whether the digital audio signal satisfies a predetermined threshold to thereby generate an analysis result in which the analysis result indicates that the external device includes a microphone if the digital audio signal satisfies the predetermined threshold. In the present embodiment, step S320 can further comprises: comparing the digital audio signal with the predetermined threshold to therefore generate the analysis result, wherein if the digital audio signal is equal to or larger than the predetermined threshold, the analysis result indicates that there is a microphone of the external device; and Step S330: executing an operation (e.g. a microphone signal process) according to the analysis result. For example, if the analysis result indicates that the external device includes a microphone, step S330 makes use of the microphone of the external device to thereby reach the purpose of enabling the microphone signal process, or uses a built-in microphone or no microphones to achieve the purpose of remaining the microphone signal process, or replaces the built-in microphone with the microphone of the external device to fulfill the purpose of switching the microphone signal process. On the other hand, if the analysis result indicates that the external device has no microphones, step S330 keeps using the built-in microphone or no microphones to achieve the purpose of remaining the microphone signal process. Please note that remaining the microphone signal process includes the condition of no microphone signals under processing.

Based on the above description, if the electronic device adopting the present method does include the built-in microphone, step S320 can further comprise:

Step S322: receiving the analog signal from the built-in microphone; and

Step S324: if the digital audio signal satisfies the predetermined threshold, generating the analysis result by additional one or more parameters. The one or more parameters are associated with at least one state of the microphone signal process, and the implementation detail thereof can be fully understood by the description of the embodiment in re FIG. 2.

Furthermore, step S330 can comprises one or more of the following steps to execute the microphone signal process: first, if the one or more parameters indicate that the state is associated with a first predetermined state (e.g. a voice recognition state), executing a first microphone signal process and stopping an ongoing second microphone signal process according to the analysis result to carry out the operation of switching the microphone signal process; second, if the one or more parameters indicate that the state is associated with a second predetermined state (e.g. a recording state), executing the second microphone signal process according to the analysis result to carry out the operation of remaining the microphone signal process; and third, if the one or more parameters indicate that the state is associated with a third predetermined state (e.g. a microphone-signalless state), executing the first microphone signal process according to the analysis result to realize the operation of enabling the microphone signal process, wherein the first microphone signal process is in connection with the microphone of the external device while the second microphone signal process is in connection with the built-in microphone.

Similarly, in order to prevent the different contact-function definitions of the plug of the external device and the socket of the electronic device using the present method from leading to an incorrect analysis result, the present embodiment can further comprises the following steps: executing an input signal swap operation; after finishing the input signal swap operation, generating the digital audio signal according to the analog input signal again; generating the analysis result in accordance with the regenerated digital audio signal; and enabling, remaining or switching the microphone signal process by the regenerated analysis result. The detail of the input signal swap operation can be well appreciated from the afore-disclosed embodiments.

Please note that since a person having ordinary skill in the art can fully appreciate the present method by the description of the corresponding microphone detection circuit, provided that the disclosure and enablement requirements of this method invention are satisfied, repeated and redundant description is omitted here.

Figure 4:
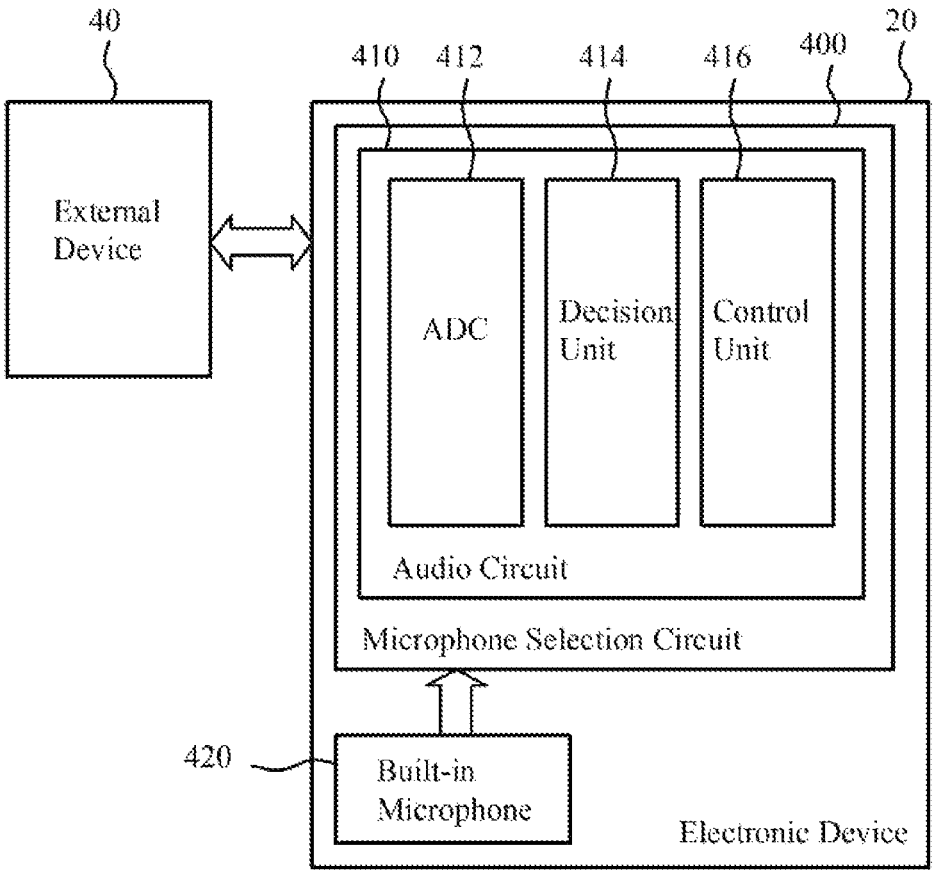
FIG. 4 illustrates an embodiment of the microphone selection circuit of the present invention.

The disclosed microphone detection circuit and method can comprise the microphone selection function. However, this microphone selection function can be carried out separately. Accordingly, the present invention provides a microphone selection circuit for selecting a microphone among a plurality of microphones. As shown in FIG. 4, an embodiment of the microphone selection circuit 400 comprises: an audio circuit 410 for receiving a first analog input signal from an external microphone 40 and/or a second analog input signal from a built-in microphone 420. In this embodiment, the audio circuit 410 includes: at least one analog-to-digital conversion unit 412 to generate a digital audio signal according to the first or second analog input signal; a decision unit 414 to generate an analysis result according to one or more parameters which are associated with at least one state of a microphone signal process and stored in one or more storage units or come from a program (e.g. an operating system) in which the one or more storage units can be integrated into the audio circuit 410 or disposed outside the audio circuit 410; and a control unit 416, coupled to the decision unit 414 and the analog-to-digital conversion unit 412, to make the analog-to-digital conversion unit 412 generate the digital audio signal according to one of the first and second analog input signals, and make the audio circuit 410 execute the microphone signal process by the digital audio signal.

Similar to the embodiment disclosure in re FIG. 2, if the above-mentioned one or more parameters indicate that the at least one state is associated with a first predetermined state (e.g. a voice recognition state), the control unit 416 makes the analog-to-digital conversion unit 412 generate the digital audio signal according to the first analog input signal, and makes the audio circuit 410 execute a first microphone signal process (e.g. using the external microphone 40 for voice recognition); and if the one or more parameters indicate that the state is associated with a second predetermined state (e.g. a recording state), the control unit 416 makes the analog-to-digital conversion unit 412 generate the digital audio signal according to the second analog input signal, and makes the audio circuit 410 execute a second microphone signal process (e.g. keeping using the built-in microphone 420 for recording). In the present embodiment, the first and second microphone signal processes won't be executed at the same time.

Figure 5:
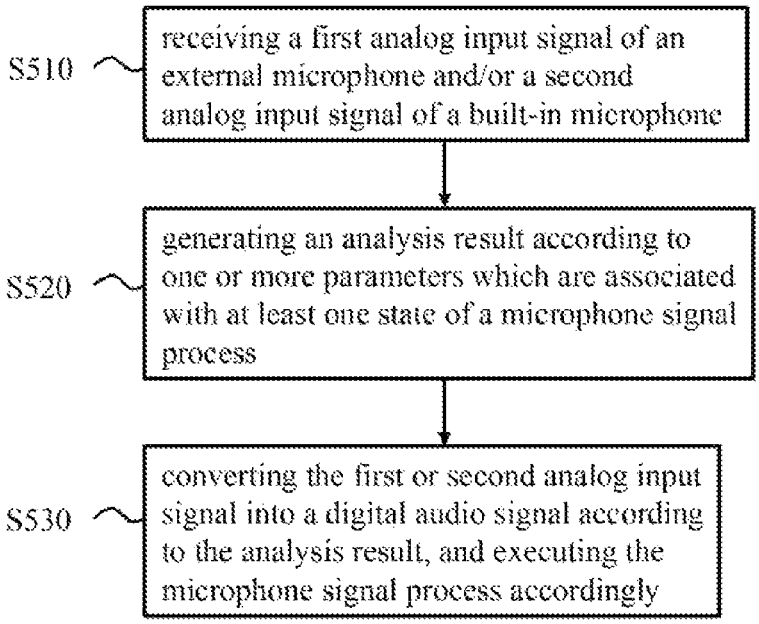
FIG. 5 illustrates an embodiment of the microphone selection method of the present invention.

Besides the above-disclosed microphone selection circuit, the present invention correspondingly provides a microphone selection method for selecting a microphone from a plurality of microphones. This method can be carried out by the microphone selection circuit 400 of FIG. 4 or other equivalent circuits. As shown in FIG. 5, an embodiment of the microphone selection method comprises the following steps:

Step S510: receiving a first analog input signal of an external microphone and/or a second analog input signal of a built-in microphone;

Step S520: generating an analysis result according to one or more parameters which are associated with at least one state of a microphone signal process; and Step S530: converting the first or second analog input signal into a digital audio signal according to the analysis result, and executing the microphone signal process with the digital audio signal accordingly.

Since one of ordinary skill in the art can appreciate more details of this method invention from the disclosure in re FIG. 2 and FIG. 4, repeated and redundant description will thus be omitted without dissatisfying the disclosure and enablement requirements. Please note that in this specification, steps of the method invention are not bound to an unchangeable order provided that the method is still workable. Please also note that the aforementioned relative terms such as "plug/socket", "satisfy/dissatisfy" or the like are just for understanding; in fact, the disclosure scope of this invention embraces the exchanged definitions of two relative terms.

To sum up, the microphone detection and selection circuits and the related methods comprise at least the following advantages: using the audio circuit to do microphone detection in digital domain to thereby avoid the problems of higher cost and larger circuit size caused by the independent analog detection circuit in the prior art; using the audio circuit to select an appropriate microphone based on the state of the microphone signal process to thereby ensure the quality of the microphone signal process; and using the audio circuit to realize microphone detection and/or microphone selection to therefore provide a simple and effective solution.

The aforementioned descriptions represent merely the preferred embodiments of the present invention, without any intention to limit the scope of the present invention thereto. Various equivalent changes, alterations, or modifications based on the claims of present invention are all consequently viewed as being embraced by the scope of the present invention.

What is claimed is:

1. A microphone detection circuit for detecting whether an external device includes a microphone, comprising:

an audio circuit for receiving an analog input signal which is a signal from the external device or a preset signal, the audio circuit including:

at least one analog-to-digital conversion unit to generate a digital audio signal according to the analog input signal;

a decision unit, coupled to the analog-to-digital conversion unit, to determine whether the digital audio signal satisfies a predetermined threshold to thereby generate an analysis result, wherein if the digital audio signal satisfies the predetermined threshold, the analysis result indicates that the external device includes the microphone; and a control unit, coupled to the decision unit, to control an operation of the audio circuit according to the analysis result, wherein when the external device includes the microphone, the analog input signal is the signal generated by the microphone and the digital audio signal generated according to the analog input signal has a value varying by time to reflect human voice or background sound, and then the decision unit determines that the digital audio signal satisfies the predetermined threshold; and when the external device includes no microphone, the analog input signal is the preset signal and the digital audio signal generated according to the analog input signal is a constant value, and then the decision unit determines that the digital audio signal fails to satisfy the predetermined threshold.

2. The microphone detection circuit of claim 1, wherein the control unit couples to the analog-to-digital conversion unit, and makes the analog-to-digital conversion unit perform an analog-to-digital conversion to the analog input signal for a predetermined time when the external device electrically couples to the audio circuit, so as to generate the digital audio signal.

3. The microphone detection circuit of claim 1, wherein the decision unit compares the digital audio signal with the predetermined threshold to thereby generate the analysis result in which the analysis result indicates that the external device includes the microphone provided that the digital audio signal is equivalent to or larger than the predetermined threshold.

4. The microphone detection circuit of claim 1, wherein the audio circuit is further for receiving the analog signal of a built-in microphone, and if the digital audio signal satisfies the predetermined threshold, the decision unit generates the analysis result according to one or more parameters which are associated with at least one state of a microphone signal process.

5. The microphone detection circuit of claim 4, wherein if the one or more parameters indicate that the at least one state conforms to a first predetermined state, the decision unit generates the analysis result accordingly, and the control unit makes the audio circuit execute a first microphone signal process in connection with the microphone of the external device and stop a second microphone signal process in connection with the built-in microphone by the analysis result, so as to switch the microphone signal process.

6. The microphone detection circuit of claim 4, wherein if the one or more parameters indicate that the at least one state conforms to a second predetermined state, the decision unit generates the analysis result accordingly and the control unit makes the audio circuit execute a second microphone signal process in connection with the built-in microphone by the analysis result, so as to remain the microphone signal process.

7. The microphone detection circuit of claim 4, wherein if the one or more parameters indicate that the at least one state conforms to a third predetermined state, the decision unit generates the analysis result accordingly and the control unit makes the audio circuit execute a first microphone signal process in connection with the microphone of the external device by the analysis result, so as to enable the microphone signal process.

8. The microphone detection circuit of claim 1, wherein if the digital audio signal satisfies the predetermined threshold, the control unit enables or switches a microphone signal process in accordance with the analysis result.

9. The microphone detection circuit of claim 1, wherein if the digital audio signal fails to satisfy the predetermined threshold, the control unit remains a microphone signal process.

10. The microphone detection circuit of claim 1, wherein if the digital audio signal fails to satisfy the predetermined threshold, the control unit executes an input signal swap operation, and then controls the analog-to-digital conversion unit to regenerate the digital audio signal according to the analog input signal and afterward controls the decision unit to regenerate the analysis result according to the regenerated digital audio signal, so as to make the audio circuit enable, remain or switch a microphone signal process according to the regenerated analysis result.

11. A microphone detection method carried out by a microphone detection circuit for detecting whether an external device includes a microphone, comprising the following steps:

generating a digital audio signal according to an analog input signal which is a signal from the external device or a preset signal;

determining whether the digital audio signal satisfies a predetermined threshold to thereby generate an analysis result in which the analysis result indicates that the external device includes the microphone if the digital audio signal satisfies the predetermined threshold; and executing an operation according to the analysis result, wherein when the external device includes the microphone, the analog input signal is the signal generated by the microphone and the digital audio signal generated according to the analog input signal has a value varying by time to reflect human voice or background sound, and then the decision unit determines that the digital audio signal satisfies the predetermined threshold; and when the external device includes no microphone, the analog input signal is the preset signal and the digital audio signal generated according to the analog input signal is a constant value, and then the decision unit determines that the digital audio signal fails to satisfy the predetermined threshold.

12. The microphone detection method of claim 11, wherein the step of generating the digital audio signal comprises:

performing an analog-to-digital conversion to the analog input signal for a predetermined time to thereby generate the digital audio signal.

13. The microphone detection method of claim 11, wherein the step of generating the analysis result comprises:

comparing the digital audio signal with the predetermined threshold to thereby generate the analysis result in which the analysis result indicates that the external device includes the microphone provided that the digital audio signal equals to or exceeds the predetermined threshold.

14. The microphone detection method of claim 11, wherein the step of generating the analysis result comprises:

receiving the analog signal of a built-in microphone; and generating the analysis result according to one or more parameters associated with at least one state of a microphone signal process if the digital audio signal satisfies the predetermined threshold.

15. The microphone detection method of claim 14, wherein the step of executing the operation according to the analysis result comprises at least one of the following steps:

if the one or more parameters indicate that the at least one state conforms to a first predetermined state, executing a first microphone signal process in connection with the microphone of the external device and stopping a second microphone signal process in connection with the built-in microphone by the analysis result, so as to switch the microphone signal process;

if the one or more parameters indicate that the at least one state conforms to a second predetermined state, executing the second microphone signal process by the analysis result to thereby remain the microphone signal process; and if the one or more parameters indicate that the at least one state conforms to a first predetermined state, executing the first microphone signal process by the analysis result to therefore enable the microphone signal process.

16. The microphone detection method of claim 11, further comprising:

executing an input signal swap operation if the digital audio signal fails to satisfy the predetermined threshold;

after finishing the input signal swap operation, regenerating the digital audio signal according to the analog input signal;

regenerating the analysis result according to the regenerated digital audio signal; and executing the operation according to the regenerated analysis result.

17. A microphone selection circuit for choosing one of a plurality of microphones, comprising an audio circuit for receiving a first analog input signal of an external microphone and a second analog input signal of a built-in microphone, the audio circuit including:

at least one analog-to-digital conversion unit to generate a digital audio signal according to the first or second analog input signal;

a decision unit to generate an analysis result according to one or more parameters associated with at least one state of a microphone signal process; and a control unit, coupled to the decision unit and the analog-to-digital conversion unit, to make the analog-to-digital conversion unit generate the digital audio signal by the first or second analog input signal in accordance with the analysis result, and make the audio circuit execute the microphone signal process with the digital audio signal, wherein when the one or more parameters indicate that the at least one state conforms to a voice recognition state, the control unit chooses the first analog input signal of the external microphone according to the analysis result to execute a first microphone signal process, when the one or more parameters indicate that the at least one state conforms to a microphone-signal-less state, the control unit makes the audio circuit use the external microphone according to the analysis result to execute the first microphone signal process, and when the one or more parameters indicate that the at least one state conforms to a recording state, the control unit chooses the second analog input signal of the built-in microphone according to the analysis result to execute a second microphone signal process.

18. The microphone detection circuit of claim 1, wherein the digital audio signal has a value varying by time to reflect human voice.

19. The microphone detection method of claim 11, wherein the digital audio signal has a value varying by time to reflect human voice.

* * * * *